US007765743B2

(12) United States Patent
Guilford

(10) Patent No.: US 7,765,743 B2
(45) Date of Patent: Aug. 3, 2010

(54) CORNER GUTTER SCREEN ASSEMBLY

(76) Inventor: Russell Guilford, 7293 Eaton Hwy., Milliken, MI (US) 48861

( * ) Notice: Subject to any disclaimer, the term of this patent is extended or adjusted under 35 U.S.C. 154(b) by 94 days.

(21) Appl. No.: 12/256,802

(22) Filed: Oct. 23, 2008

(65) Prior Publication Data

US 2009/0107053 A1 Apr. 30, 2009

Related U.S. Application Data

(60) Provisional application No. 60/982,459, filed on Oct. 25, 2007.

(51) Int. Cl.
*E04D 13/00* (2006.01)
*B01D 39/10* (2006.01)

(52) U.S. Cl. ..... 52/12; 52/13; 52/97; 210/474; 210/499; 248/48.1; 248/220.1

(58) Field of Classification Search ..... 52/11–16, 52/97, 287.1, 842, 843, 844, 537; 239/193, 239/461, 589; 405/118, 119; 248/48.1, 48.2; 138/118, 119; 210/154, 162, 163, 474, 499, 210/482
See application file for complete search history.

(56) References Cited

U.S. PATENT DOCUMENTS

| | | | | | |
|---|---|---|---|---|---|
| 2,537,243 | A * | 1/1951 | Swartz | 52/12 |
| 3,950,951 | A * | 4/1976 | Zukauskas | 405/119 |
| 4,112,632 | A * | 9/1978 | Simpson | 52/11 |
| 4,586,298 | A | 5/1986 | Colp | |
| 4,765,101 | A | 8/1988 | Wolf | |
| 4,965,969 | A * | 10/1990 | Antenen | 52/12 |
| 5,040,750 | A * | 8/1991 | Brant | 248/48.2 |
| 5,095,666 | A * | 3/1992 | Williams, Jr. | 52/11 |
| 5,566,513 | A * | 10/1996 | Herren | 52/12 |
| 5,623,787 | A * | 4/1997 | Ali | 52/13 |
| 6,085,466 | A * | 7/2000 | Martin et al. | 52/13 |
| 6,427,388 | B1 | 8/2002 | Brochu | |
| 6,883,760 | B2 * | 4/2005 | Seise, Jr. | 248/48.1 |
| 7,198,714 | B2 | 4/2007 | Swistun | |
| 2001/0017008 | A1 * | 8/2001 | Kuhns | 52/11 |
| 2002/0124476 | A1 * | 9/2002 | Iannelli | 52/11 |
| 2002/0152691 | A1 * | 10/2002 | Wade | 52/11 |
| 2005/0115160 | A1 * | 6/2005 | Brochu | 52/11 |
| 2006/0230687 | A1 * | 10/2006 | Ealer, Sr. | 52/12 |

* cited by examiner

*Primary Examiner*—Robert J Canfield
*Assistant Examiner*—Babajide Demuren
(74) *Attorney, Agent, or Firm*—Young Basile Hanlon & MacFarlane PC

(57) ABSTRACT

A rain gutter screen assembly for use at the inside corner of a rain gutter. The assembly includes a screen having portions sized to overlie intersecting ends of the rain gutter sections, to allow water cascading down the roof corner to flow into the intersecting ends while blocking the entry of debris into the intersecting ends, and a central portion sized to extend outwardly beyond outboard edges of the intersecting ends in cantilever fashion; and a frame structure mounting outboard edges of the screen and defining a plate extending outwardly beyond the outboard edges of the intersecting ends in cantilever fashion in underlying relation to the central screen portion, whereby cascading water trajecting beyond the intersecting ends may pass through the central screen portion and onto the cantilever plate for redirection into the rain gutter sections.

19 Claims, 5 Drawing Sheets

CORNER GUTTER SCREEN ASSEMBLY

CROSS-REFERENCE TO RELATED APPLICATION

This application claims the benefit of the provisional patent application 60/982,459 filed on Oct. 25, 2007 which is incorporated herein in its entirety by reference.

BACKGROUND OF THE INVENTION

This invention relates to a screen assembly for rain gutters and more particularly to a screen assembly especially suited for use at the inside corners of rain gutters.

Rain gutters are in common use on building structures to control the run off of water from the roof of the associated building. Problems arise with respect to the collection of debris in the gutters and with respect to water cascading off of the roof of the structure and falling onto the ground below. The cascading water problem is particularly acute in inside corner situations where water cascades down the corner valley formed where two different surfaces of the roof intersect.

Various assemblies have been proposed to address the problem of debris accumulation and the cascading problem in inside corner scenarios, but none of the proposed assemblies have been totally satisfactory.

SUMMARY OF THE INVENTION

This invention is directed to the provision of an improved screen assembly for an inside rain gutter corner.

More particularly, this invention is directed to an inside corner screen assembly that precludes entry of debris into the gutters and effectively controls the water cascading off of the roof valley.

The invention rain gutter assembly is a corner rain gutter assembly for use at an inside corner formed by intersecting rain gutter sections secured at inboard edges thereof to an associated structure below a roof corner of a structure.

The invention screen assembly includes a screen having portions sized to overlie the intersecting ends of the gutter sections, to allow water cascading down the roof corner to flow into the intersecting ends of the rain gutter sections while blocking the entry of debris into the intersecting ends of the rain gutter sections, and a central portion sized to extend outwardly beyond outboard edges of the rain gutter sections in cantilever fashion; and a frame structure mounting outboard edges of the screen and defining a plate extending outwardly beyond the outboard edges of the rain gutter sections in cantilever fashion in underlying relation to the central screen portion, whereby cascading water projecting beyond the rain gutter sections may pass through the central screen portion and onto the cantilevered plate for redirection into the rain gutter sections.

According to a further feature of the invention, the frame structure further defines a dam positioned between the screen central portion and the plate proximate outboard edges of the screen central portion and the plate and operative to assist the plate in redirecting cascading water passing downwardly through the screen central portion and onto the plate into the rain gutter sections.

According to a further feature of the invention, the central screen portion and the underlying plate have a triangular configuration with the hypotenuse of the triangle extending in angled fashion between the outboard edges of the intersecting rain gutter sections.

According to a further feature of the invention, the frame structure includes a base member defining the plate and a frame member positioned on the base member, mounting the outboard edges of the screen, and defining the dam between the screen central portion and the plate.

According to a further feature of the invention, the base member further defines an upstanding lip proximate the outboard edge of the plate and the frame member is positioned on the base member with the dam defined by the frame member positioned against the upstanding lip of the base member.

According to a further feature of the invention, the screen assembly is intended for use with gutter sections including an upstanding outboard front portion and the frame structure further defines pilot flange portions downstanding from an inboard edge of the plate and sized to extend downwardly into the rain gutter sections immediately inboard of the outboard front portions of the rain gutter sections whereby to locate the screen assembly relative to the gutter sections and preclude inadvertent displacement of the screen assembly from the gutter sections.

According to a further feature of the invention, the frame structure defines a catch basin extending outwardly beyond the outboard edges of the rain gutter sections in cantilever fashion whereby cascading rainwater projecting beyond the rain gutter sections may be caught and redirected into the rain gutter sections.

BRIEF DESCRIPTION OF THE DRAWINGS

The description herein makes reference to the accompanying drawings wherein like reference numerals refer to like parts throughout the several views and wherein.

DETAILED DESCRIPTION OF THE PREFERRED EMBODIMENT

The screen assembly 10 is intended for use with a gutter 12 of standard design and specifically is intended for use at an existing inside miter of the eavestrough formed at the inside corner intersection 12*a* of right angle related gutter sections 12*b* and 12*c* secured at inboard edges thereof to the related housing structure.

Figure 1:
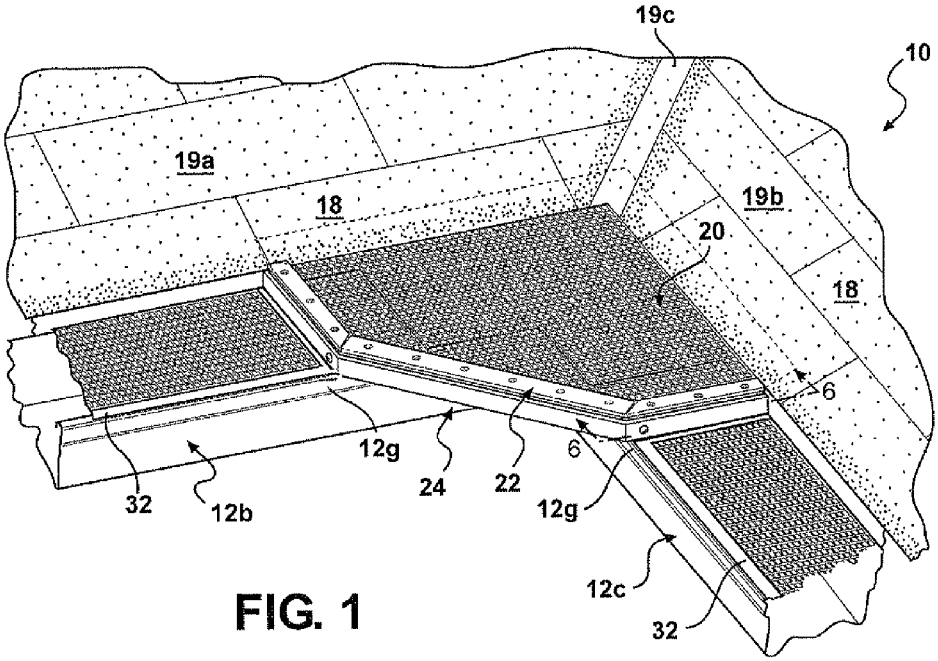
FIG. 1 is an overhead perspective view showing a corner gutter screen assembly according to the invention installed at the corner of a gutter of a home.
Figure 6:
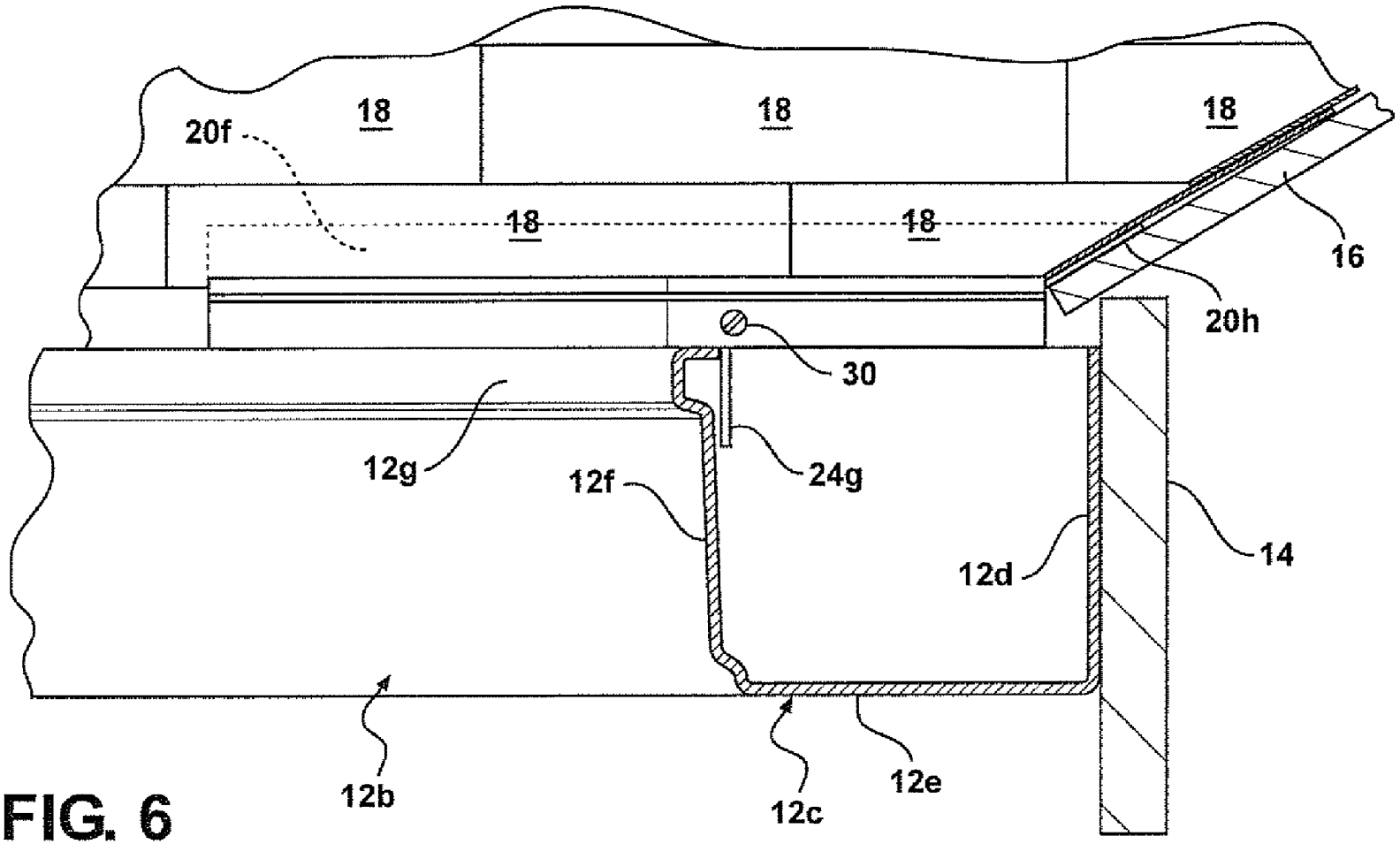
FIG. 6 is a view of the screen assembly looking in the direction of the arrow 6 in FIG. 1.

Each gutter section in known manner (FIG. 6) has a trough cross-sectional configuration including an upstanding inboard mounting portion 12*d* for securement in known manner to a face board 14 of the related housing structure, a bottom portion 12*e*, and an upstanding outboard front portion 12*f* terminating in a lip 12*g*. The related housing structure will also include, in known manner, roofing boards 16, shingles 18 suitably secured in overlying and overlaping relation to the roofing boards, and roof surfaces 19*a*/19*b* intersecting to form a roof valley 19*c* (FIG. 1).

The screen assembly, broadly considered, includes a screen 20 and a frame structure including a frame member 22 and base member 24.

Figure 3:
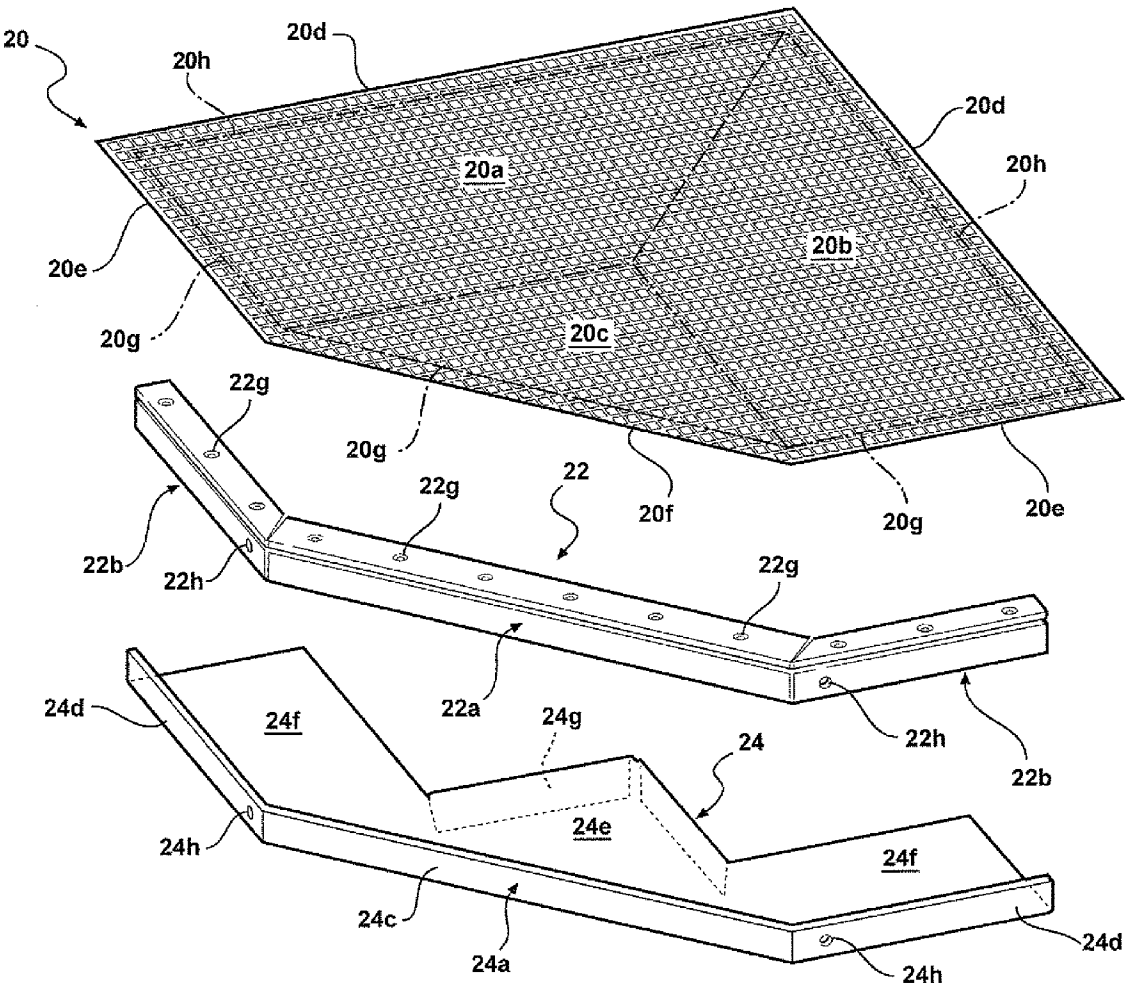
FIG. 3 is an exploded view of the screen assembly.

Screen 20 (FIG. 3) comprises standard shelf item mesh screen stock. Screen 20 includes generally rectangular edge portions 20*a*, 20*b* mitered and sized to overlie the intersecting mitered ends of gutter sections 12*b*, 12*c* respectively and a right angle central triangular portion 20*c*. The screen further defines right angle related inboard edges 20*d*, side edges 20*e*, and an angled outboard edge 20*f* extending as the hypotenuse of right angle portion 20*c* between side edges 20*e*.

Figure 4:
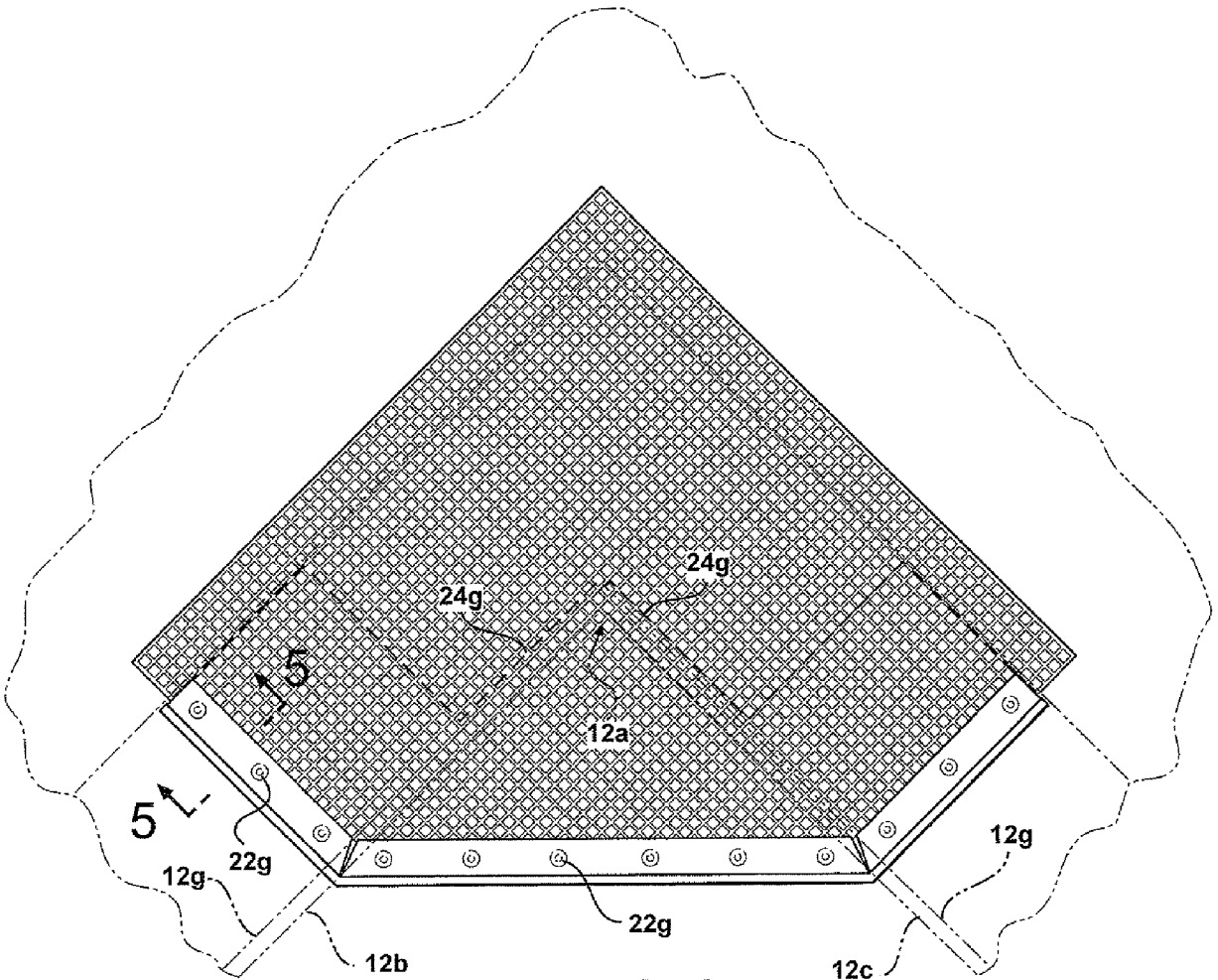
FIG. 4 is a plan view of the screen assembly.

Frame member 22 (FIGS. 3, 4, 5) may be formed of standard sheet metal stock and includes a central section 22*a* and end sections 22*b* angled with respect to the central section at an angle conforming to the angle formed by the screen edges 20*f*/20*e*.

Figure 5:
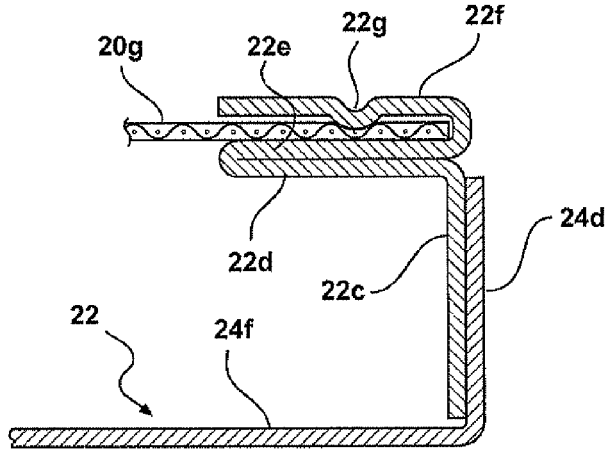
FIG. 5 is a cross sectional view taken on lines 5-5 of FIG. 4.

Each section 22*a*/22*b* of the frame member, in cross-section as seen in FIG. 5, includes an upstanding rim portion 22*c*, a flange portion 22*d* at right angles with respect to rim portion 22*c*, a further flange portion 22*e* folded back onto flange portion 22*d*, and a further flange portion 22*f* reverse folded back onto flange portion 22*e*. The respective edge portions 20*g* of screen 20 adjacent edges 20*e*/20*f* are clamped between flange portions 22*e* and 22*f* of the respective frame member sections, such for example as by forming spaced dimples or crimps 22*g* in the flange portions 22*f*.

Figure 2:
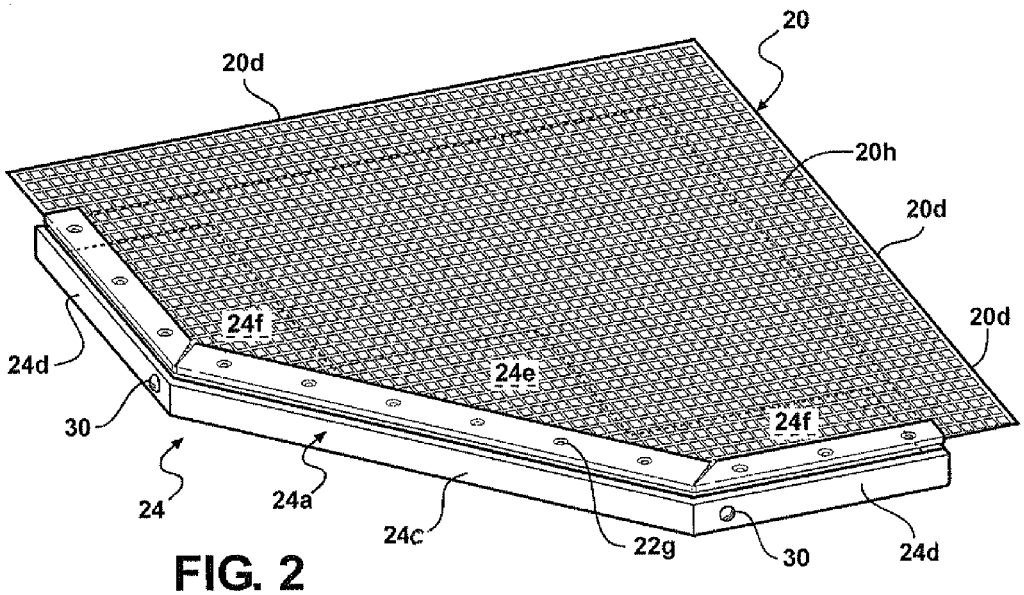
FIG. 2 is a perspective view of the screen assembly.
Figure 7:
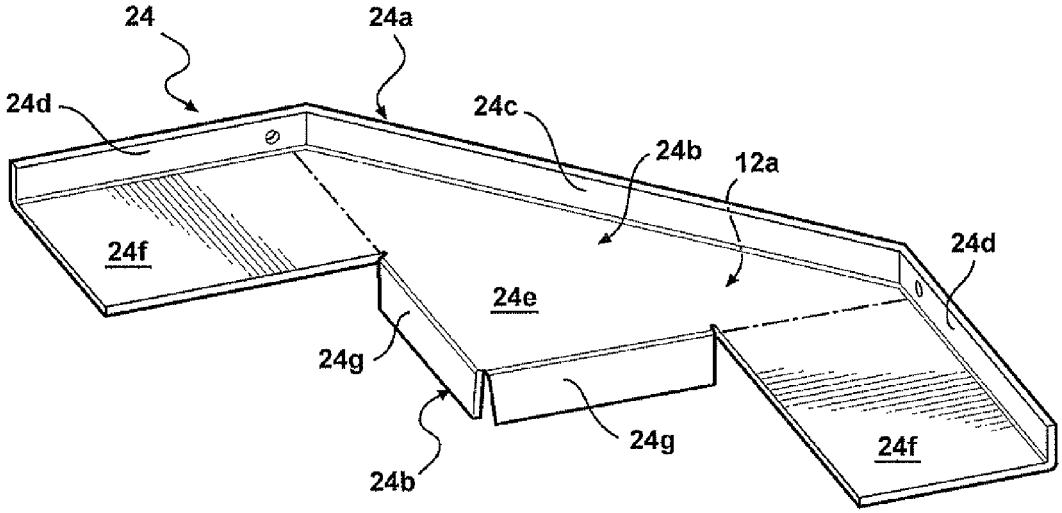
FIG. 7 is a detailed perspective view of a base member utilized in the screen assembly.

Base member 24 (FIGS. 2, 3, 7) is formed of suitable sheet metal stock and includes a rim or lip portion 24*a* and a plate portion 24*b*. Rim portion 24*a* includes a central rim portion 24*c* and rim end portions 24*d* flanking the central portion and angled with respect to the central portion at an angle conforming to the angle formed by screen edges 20*e*/20*f* and frame member portions 22*a*/22*b*. Plate portion 24*b* includes a central right angle triangular portion 24*e*, generally rectangular end portions 24*f*, and pilot flange portions 24*g* downstanding at right angles from central portion 24*e*.

In assembled relation, respective outboard screen edge portions 20*g* are clamped between the reverse flange portions of the respective frame sections 20*a*/20*b* of frame member 20 utilizing crimps 22*g*; the frame and screen assembly is positioned on the base member 24 with the end portions 22*b* of the frame member contiguous to and inboard of the base member rim end portions 24*d* and the central frame portion 22*a* contiguous to and inboard of the central base member rim portion 24*c*; and suitable screws 30 are passed freely through apertures 24*h* in base member rim end portions 24*d* for threaded engagement with apertures 22*h* in the rim portion of frame member end portions 22*b* to fixedly secure the frame member and screen subassembly to the base member.

In use, screen assembly 10 is positioned over gutter section corner 12*a* with base member plate end portions 24*f* seated on gutter sections 24*b*/24*c*; pilot flange portions 24*g* positioned immediately inboard of front portions 12*f* of gutter sections 12*b*/12*c* to locate the screen assembly relative to the gutter sections and preclude inadvertent displacement of the screen assembly from the gutter sections; screen edge portions 20*a*/20*b* overlying the intersecting ends of gutter sections 12*b*/12*c*; screen central portion 20*c* extending in cantilever fashion outwardly from the outboard edges of gutter sections 12*b*/12*c*; base member central plate portion 24*e* extending in cantilever fashion outwardly from the outboard edges of gutter sections 24*b*/24*c* in underlying relation to screen central portion 20*c*; and screen inboard edge portions 20*h* angled upwardly and positioned between the respective roof boards 16 and the respective shingles 18.

With this arrangement, the screen edge portions 20*a*/20*b* preclude the entry of debris into the gutter sections 12*b*/12*c* but allow rain cascading down the roof valley 19*c* at the corner of the roof to be deposited into gutter sections 12*b*/12*c* while water trajecting beyond the rain gutter sections passes through the cantilevered portion 20*c* of the screen and onto the cantilevered base member central plate portion 24*e* where the plate member portion 24*e*, in coaction with the dam formed by rim portion 22*c* of central frame member portion 22*a*, acts as a catch basin to intercept the cascading water and redirect it into the gutter sections 12*a*/12*d* so that there is no rainwater overflow onto the area beneath the corner of the gutter.

Preferably, and as best seen in FIG. 1, auxiliary screen members 32 of known commercial design may be provided proximate each end of the invention corner gutter screen assembly so as to provide protection in known manner from debris that might otherwise be deposited in the gutter sections.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A corner rain gutter screen assembly for use at an inside corner formed by intersecting ends of rain gutter sections secured at inboard edges thereof to an associated structure below a roof corner of the structure, the gutter screen assembly comprising:

a screen having portions sized to overlie the intersecting ends of the gutter sections, to allow water cascading down the roof corner to flow into the intersecting ends of the rain gutter sections while blocking the entry of debris into the intersecting end of the rain gutter sections, and a central portion sized to extend outwardly beyond outboard edges of the intersecting ends of the rain gutter sections in cantilever fashion; and a frame structure mounting outboard edges of the screen and defining a plate extending outwardly beyond the outboard edges of the intersecting ends of the rain gutter sections in cantilever fashion in underlying relation to the central screen portion, whereby cascading water trajecting beyond the intersecting ends of the rain gutter sections may pass through the central screen portion and onto the cantilevered plate for redirection into the rain gutter sections.

2. A gutter screen assembly according to claim 1 wherein the frame structure further defines a dam positioned between the screen central portion and the plate proximate outboard edges of the screen central portion and the plate and operative to assist the plate in redirecting cascading water passing downwardly through the screen central portion and onto the plate into the rain gutter sections.

3. A gutter screen assembly according to claim 2 wherein the central screen portion and the underlying plate have a triangular configuration with the hypotenuse of the triangle extending in angled fashion between the outboard edges of the intersecting rain gutter sections.

4. A gutter screen assembly according to claim 3 wherein the frame structure includes a base member defining the plate and a frame member positioned on the base member, mounting the outboard edges of the screen, and defining the dam between the screen central portion and the plate.

5. A gutter screen assembly according to claim 4 wherein:

the base member further defines an upstanding lip proximate the outboard edge of the plate; and the frame member is positioned on the base member with the dam defined by the frame member positioned against the upstanding lip of the base member.

6. A gutter screen assembly according to claim 1 in combination with a pair of rain gutter sections intersecting to form a corner.

7. A gutter screen assembly according to claim 1 wherein:

the screen assembly is intended for use with gutter sections including an upstanding outboard front portion; and the frame structure further defines pilot flange portions downstanding from an inboard edge of the plate and sized to extend downwardly into the intersecting ends of the rain gutter sections immediately inboard of the upstanding outboard front portions of the rain gutter sections whereby to locate the screen assembly relative to the gutter sections and preclude inadvertent displacement of the screen assembly from the gutter sections.

8. A corner rain gutter screen assembly for use at an inside corner formed by intersecting ends of rain gutter sections secured at inboard edges thereof to an associated structure below a roof corner of the structure, the gutter screen assembly comprising:

a screen having portions sized to overlie the intersecting ends of the gutter sections, to allow water cascading down the roof corner to flow into the intersecting ends of the rain gutter sections while blocking the entry of debris into the intersecting ends of the rain gutter sections; and a frame structure mounting outboard edges of the screen and defining a catch basin extending outwardly beyond the outboard edges of the intersecting ends of the rain gutter sections in cantilever fashion, whereby cascading water trajecting beyond the rain gutter sections may be caught and redirected into the rain gutter sections.

9. A gutter screen assembly according to claim 8 wherein:

the frame structure defines a plate extending outwardly beyond the outboard edges of the intersecting ends of the rain gutter sections in cantilever fashion and a dam upstanding from an outboard edge of the plate; and the catch basin is defined by the plate in coaction with the dam.

10. A gutter screen assembly according to claim 9 wherein the screen further includes a central portion sized to extend outwardly beyond the outboard edges of the intersecting ends of the gutter sections in cantilever fashion and in overlying relation to the plate.

11. A gutter screen assembly according to claim 9 wherein the dam is positioned between outboard edges of the plate and the screen central portion.

12. A gutter screen assembly according to claim 11 wherein the plate and the screen central portion have a generally right triangular configuration.

13. A gutter screen assembly according to claim 12 wherein the frame structure includes a base member defining the plate and a frame member positioned on the base member, mounting the outboard edges of the screen, and defining the dam between the screen central portion and the plate.

14. A gutter screen assembly according to claim 13 wherein:

the base member further defines an upstanding lip proximate the outboard edge of the plate; and the frame member is positioned on the base member with the dam defined by the frame member positioned against the upstanding lip of the base member.

15. A gutter screen assembly according to claim 8 in combination with a pair of rain gutter sections intersecting to form a corner.

16. A corner rain gutter shield assembly for use at an inside corner formed by intersecting ends of rain gutter sections secured at inboard edges thereof to an associated structure below a roof corner of the structure, the gutter shield assembly comprising:

drainage members sized to overlie the intersecting ends of the gutter sections to allow water cascading down the roof corner to flow into the intersecting ends of the rain gutter sections while blocking the entry of debris into the intersecting ends of the rain gutter sections;

a plate extending outwardly beyond the outboard edges of the intersecting ends of the rain gutter sections in cantilever fashion; and a dam upstanding from an outboard edge of the plate and operative in coaction with the plate to intercept cascading water trajecting beyond the drainage members and redirect the water into the gutter sections.

17. A rain gutter shield assembly according to claim 16 wherein:

the shield assembly includes a screen; and the drainage members are constituted by portions of the screen.

18. A rain gutter shield assembly according to claim 17 wherein the screen further includes a central portion extending outwardly beyond the outboard edges of the intersecting ends of the gutter sections in cantilever fashion in overlying relation to the plate.

19. A rain gutter shield assembly according to claim 18 wherein the dam is formed between the plate and the central screen portion proximate outboard edges of the plate and the central screen portion.

* * * * *